United States Patent [19]

Logan, Jr.

[11] 4,230,194

[45] Oct. 28, 1980

[54] ROTARY DRILL BIT

[76] Inventor: Clifford K. Logan, Jr., 7920 Hemingford Ct., Apt. A, Oklahoma City, Okla. 73120

[21] Appl. No.: 14,637

[22] Filed: Feb. 23, 1979

Related U.S. Application Data

[63] Continuation-in-part of Ser. No. 969,810, Dec. 15, 1978.

[51] Int. Cl.[2] ..... E21B 9/12

[52] U.S. Cl. ..... 175/379; 175/336

[58] Field of Search ..... 175/333, 336, 379, 332

[56] References Cited

U.S. PATENT DOCUMENTS

| | | | |
|---|---|---|---|
| 1,163,867 | 12/1915 | Shaffer | 175/379 |
| 1,505,460 | 8/1924 | Grlesche | 175/379 |
| 1,572,386 | 2/1926 | Gates | 175/379 |
| 1,731,262 | 10/1929 | Phipps | 175/333 |
| 1,987,853 | 1/1935 | Howard et al. | 175/333 |
| 2,203,747 | 6/1940 | Sandstone | 175/379 |
| 2,342,931 | 2/1944 | Fortune | 175/379 |
| 2,830,795 | 4/1958 | Center, Jr. | 175/379 |
| 2,833,520 | 4/1958 | Owen | 175/379 |
| 2,966,949 | 1/1961 | Wepsala, Jr. | 175/379 |
| 3,055,443 | 9/1962 | Edwards | 175/333 |
| 3,295,617 | 1/1967 | Willis | 175/379 |
| 3,495,359 | 2/1970 | Smith et al. | 175/379 |

*Primary Examiner*—James A. Leppink

*Attorney, Agent, or Firm*—C. Clark Dougherty, Jr.

[57] ABSTRACT

An improved rotary drill bit comprised of two or more elongated generally cylindrical drill members, the lower ends of which form a cutting face. A plurality of vertically spaced rows of rotatable cutting members are positioned around and between the drill members and are journaled thereto whereby as the lowermost row of the rotatable cutting members and the lower ends of the drill members wear away, the next adjacent row of cutting members is exposed.

16 Claims, 9 Drawing Figures

ROTARY DRILL BIT

CROSS-REFERENCE TO RELATED APPLICATION

This application is a continuation-in-part of application Ser. No. 969,810 filed Dec. 15, 1978.

BACKGROUND OF THE INVENTION

1. Field of the Invention

The present invention relates generally to an improved rotary drill bit, and more particularly, but not by way of limitation, to a rotary drill bit having cutting edges and cutting members thereon which are continuously renewed as the drill bit wears away.

2. Description of the Prior Art

In the drilling of oil, gas and water wells by rotary drilling techniques, the drill bits utilized are subject to abrasion and deterioration whereby the teeth and/or cutting surfaces are removed making it necessary to periodically replace the drill bits. In the drilling of deep wells through hard rock and the like, heretofore used drill bits often must be replaced at relatively short intervals. The replacement of the drill bit involves withdrawing the drill string from the well bore, replacing the drill bit and then reinserting the drill string into the well bore which brings about a considerable time delay and expense.

By the present invention, an inproved rotary drill bit is provided which includes a cutting face having cutting edges and rotatable cutting members thereon which are continuously renewed or reformed as the cutting face wears away whereby replacment of the drill bit because of wear and abrasion is obviated.

It is, therefore, a general object of the present invention to provide an improved rotary drill bit.

A further object of the present invention is the provision of a rotary drill bit having a cutting face with cutting edges and rotatable cutting members thereon which are continuously reformed or renewed as the cutting face and cutting members wear away thereby making it unnecessary to replace the drill bit during drilling operations.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
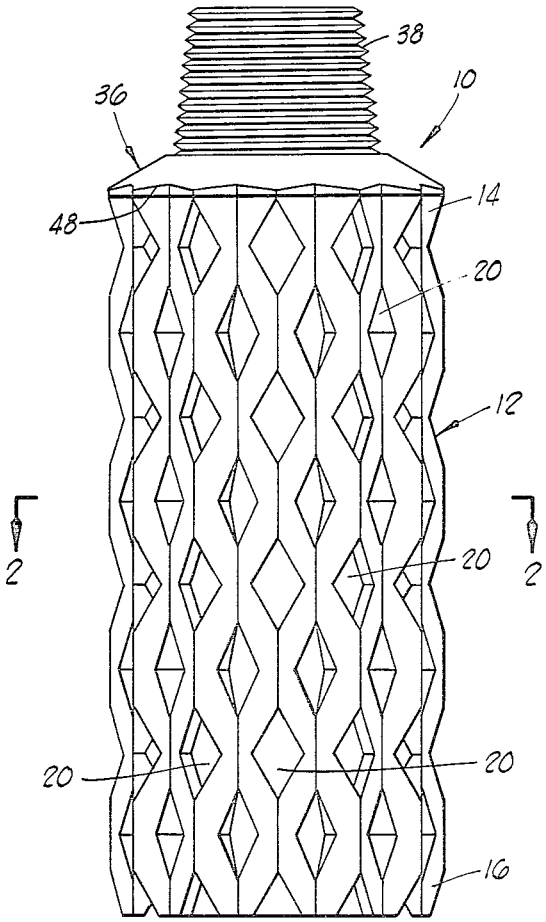
FIG. 1 is a side elevation view of the improved rotary drill bit of the present invention.
Figure 3:
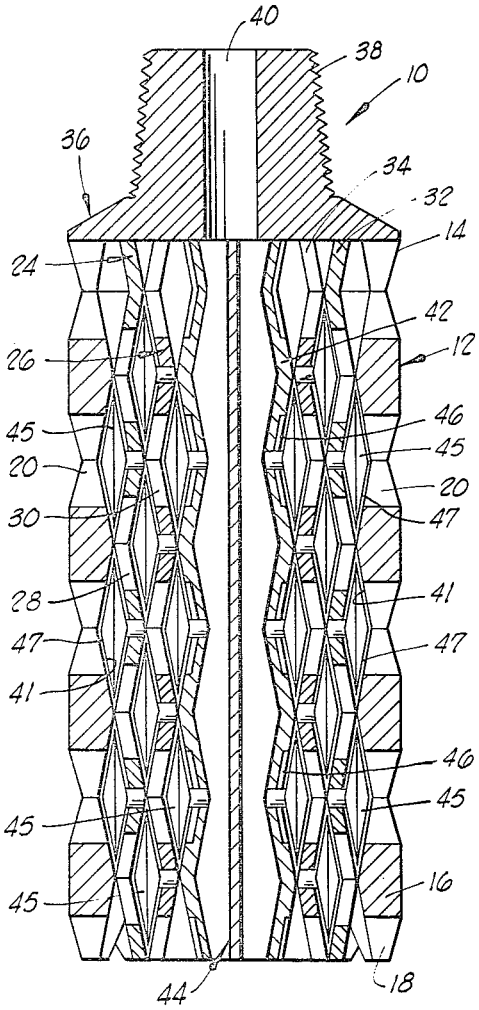
FIG. 3 is a cross-sectional view taken along line 3—3 of FIG. 2.
Figure 2:
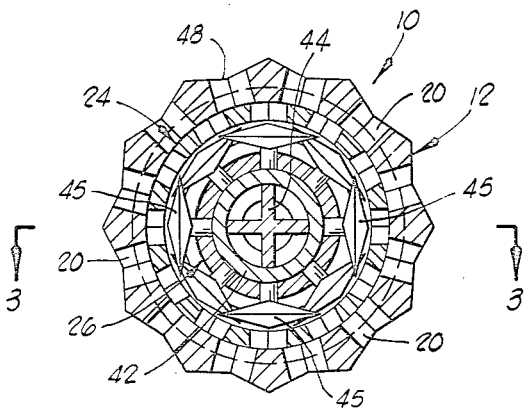
FIG. 2 is a cross-sectional view taken along line 2—2 of FIG. 1.

Referring now to FIGS. 1–3, to drill bit apparatus of the present invention is illustrated and generally designated by the numeral 10. The apparatus 10 is comprised of an elongated generally cylindrical outer drill member 12 having an upper end 14 and a lower end 16 which forms an annular cutting face 18. A plurality of vertically spaced rows of diamond-shaped openings 20 are disposed in the sides of the outer drill member 12. As best shown in FIG. 1, the openings 20 in adjacent rows are offset from each other and overlap at their upper and lower ends. A plurality of continuous longitudinal recesses 48 are formed in the outer surface of the outer drill member 12.

Positioned concentrically within the outer drill member 12 are a pair of inner drill members 24 and 26. That is, the inner drill member 24 is of a size such that it fits snugly within the outer drill member 12 and the inner drill member 26 is of a size such that it fits snugly within the inner drill member 24. The inner drill members 24 and 26 are of lengths corresponding to the outer drill member 12 and both include rows of diamond-shaped openings 28 and 30 formed therein with the openings in adjacent rows being offset from each other and overlapping at their upper and lower ends in the same manner as the openings 20 in the outer drill member 12. The upper end 14 of the outer drill member 12 and the upper ends 32 and 34 of the inner drill members 24 and 26, respectively, are welded to a bit head 36. The bit head 36 includes a threaded shank 38 adapted to be connected to a drill string in the usual manner and a passageway 40 is provided in the bit head 36 for conducting drilling fluid from the drill string into the drill bit 10.

Positioned within the inner drill member 26 is a drilling fluid conduit 42. The conduit 42 is of a length corresponding to the outer and inner drill members and is seal welded to the bit head 36 over the passageway 40 thereof. Positioned within and welded to the inside surfaces of the drilling fluid conduit 42 is an elongated cutter member 44 which is preferably X-shaped in cross section. That is, two elongated plates are welded together to form the member 44 having an X-shape in cross section and the member 44 is in turn welded within the drilling conduit 42 whereby it extends the full length of the drilling fluid conduit. As well be understood by those skilled in the art, a single plate which intersects the center line of the drilling fluid conduit can be used or the cutter member 44 can have other cross-sectional shapes.

As best shown in FIG. 3, the walls of each of the inner drill members 24 and 26 and the drilling fluid conduit 42 are of zig-zag shape in vertical cross section and the inside surfaces of the outer drill member 12 are formed in a corresponding zig-zag shape whereby annular spaces 41 of diamond vertical cross section are formed between the outer drill member 12, the inner drill members 24 and 26 and the drilling fluid conduit 42.

As shown in FIGS. 2 and 3, the drilling fluid conduit includes a plurality of vertically spaced rows of diamond-shaped indentations or recesses 46 formed in the outer surface thereof. The recesses 46 in adjacent rows are offset from each other and overlap at their upper and lower ends in the same manner as the diamond-shaped openings 20, 28 and 30 in the outer drill member 12 and the inner drill members 24 and 26, respectively.

Figure 6:
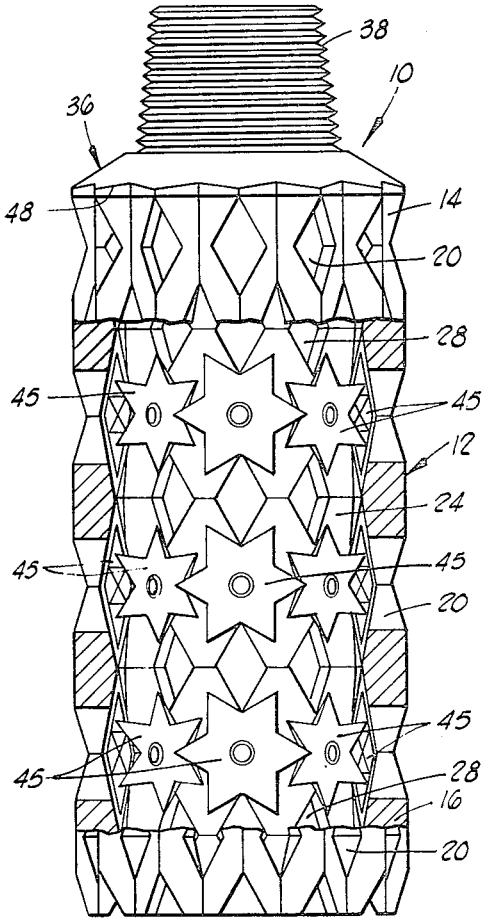
FIG. 6 is a partial side view of one of the inner drill members shown in FIGS. 2 and 3 including the rotatable cutting members journaled thereto.
Figure 8:
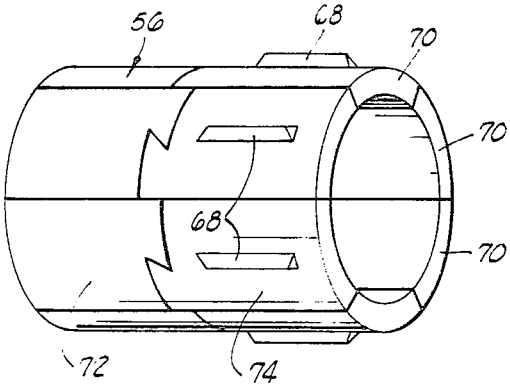
FIG. 8 is an enlarged perspective view of the bearing sleeve shown in FIG. 5.

A plurality of vertically spaced rows of rotatable cutting members 45 are positioned around and between the outer drill member 12, the inner drill members 24 and 26 and the drilling fluid conduit 42. The rotatable cutting members 45 are each journaled to one of the inner drill members 24 and 26 or the drilling fluid conduit 42, and as best shown in FIG. 6 which illustrates the inner drill member 24 and the rotatable cutting members 45 attached thereto, the rotatable cutting members 45 in adjacent rows are offset from each other and the rows of rotatable cutting members 45 attached to the inner drill member 24 are offset from the rows of cutting members 45 attached to the inner drill member 26. As will be understood by those skilled in the art, additional inner drill members can be utilized concentrically positioned one within the other between the inner drill member 26 and the drilling fluid conduit 42 having additional rotatable cutting members 45 attached thereto.

The entire drill bit 12 is formed of hard steel or other strong hard material and the drill members and drilling fluid conduit are welded to the bit head 36 and to each other. In operation of the drill bit 10, the threaded shank 38 of the bit head 36 is connected to a drill string in a conventional manner and the drill string and drill bit 10 are used to drill a well bore using conventional rotary drilling techniques. The lower ends of the outer drill member 12, inner drill members 24 and 26, the drilling fluid conduit 42, the cutter member 44 disposed within the drilling fluid conduit 42 and the lowermost row of rotatable cutting members 45 form a cutting face including cutting edges formed by the diamond-shaped openings in the drill members and by the rotatable cutting members 45. As the drill bit 10 is rotated against an earth formation through which a well bore is being drilled, drilling fluid pumped through the drill string flows through the bit head 36 by way of the passageway 40 and the drilling fluid conduit 42 and is discharged at the bottom of the drill bit 10 from where it flows by way of the longitudinal recesses 48 in the outside surface of the outer drill member 12 above the drill bit 10 and up the well bore to the surface. The drilling fluid is circulated in the usual manner and serves to carry the bit cuttings as well as the various parts of the rotatable cutting members 45 to be described hereinbelow to the surface. As the bottom annular cutting faces of the outer drill member 12, and the inner drill members 24 and 26 wear down due to abrasion, new cutting edges are continuously formed in the outer and inner drill members because of the overlapping diamond-shaped openings 20, 28 and 30 disposed therein. The rotatable cutting members 45 and the drilling fluid conduit 42 and the cutter member 44 also wear away as the drill bit 10 is rotated, and as the lowermost row of the rotatable cutting members 45 are worn away, the next adjacent row or rows of cutting members 45 are exposed. The diamond-shaped recesses 46 provided in the outside surface of the drilling fluid conduit 42 continuously provide cutting edges on the conduit 42 as it is abraded and the cutter member 44 functions to cut the center portion of the hole being drilled. As will be understood by those skilled in the art, the overall length of the drill bit 10 is such that it can be utilized for drilling a well bore of any depth without being replaced thereby avoiding the necessity of periodicially pulling the drill string for such purpose. The diamond-shaped openings in the drill members, the diamond-shaped recesses in the drilling fluid conduit and the adjacent rows of rotatable cutting members bring about the continuous presence of cutting edges on the cutting face of the drill bit 10 as the cutting face wears.

Figure 4:
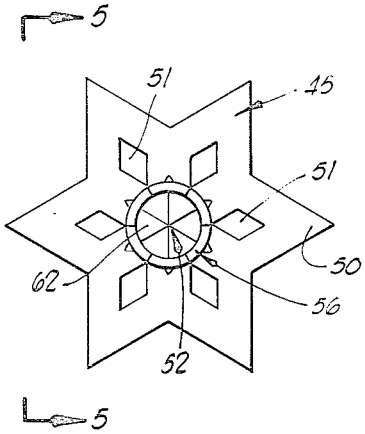
FIG. 4 is an enlarged side view of one of the rotatable cutting members shown in FIG. 3.
Figure 5:
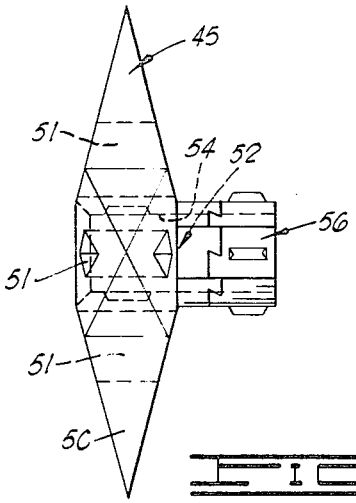
FIG. 5 is an enlarged end view taken along line 5—5 of FIG. 4.

Referring now to FIGS. 4, 5 and 7–9, one of the rotatable cutting members 45 as well as the shaft and bearing assembly associated therewith is illustrated in detail. Referring specifically to FIGS. 4 and 5, each of the rotatable cutting members 45 is star-shaped and includes a plurality of sharp cutter points 50. A removable segmented and interlocking shaft 52 which will be described in greater detail hereinbelow is disposed within a transverse central bore 54 in the cutting member 45. The shaft 52 extends outwardly from one side of the cutting member 45 and a segmented interlocked bearing member 56 is disposed over the extending portion of the shaft 52.

Figure 7:
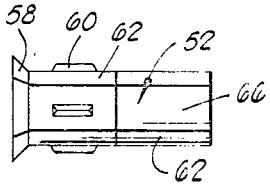
FIG. 7 is a side view of the removable shaft shown in FIG. 5.
Figure 9:
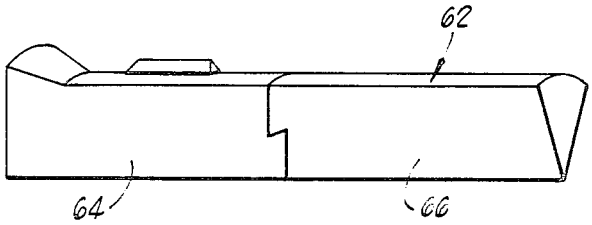
FIG. 9 is an enlarged perspective view of two of the interlocking pieces making up the shaft shown in FIG. 7.

As is best shown in FIGS. 5 and 7, the segmented shaft 52 includes a flanged end 58 which corresponds to and fits into a beveled recess in the cutting member 45. In addition, the shaft 52 includes a plurality of splines 60 uniformly spaced around the periphery thereof adjacent the flange 58 which correspond to and fit into grooves formed within the bore 54 in the cutting member 45. Referring specifically to FIGS. 4, 7 and 9, the shaft 52 is formed of a plurality of segmented pieces 62. As best shown in FIG. 9, each of the segmented pieces 62 is formed of a pair of small interlocking parts 64 and 66.

As will be understood, the segmented bearing sleeves 56 of each of the rotatable cutting members 45 is removably disposed in a corresponding bore or opening in the inner drill members 24 and 26 and drilling fluid conduit 42 of the apparatus 10. The bearing sleeve 56 includes a plurality of uniformly spaced splines 68 positioned around the periphery thereof which are engaged by corresponding grooves in the openings in the drill members and drilling fluid conduit. Like the shaft 52, the bearing sleeve 56 is formed of a plurality of segmented pieces 70 which are each in turn formed of a pair of interlocking parts 72 and 74.

Each of the rotatable cutting members 45 includes a plurality of spaced openings 51 positioned parallel and adjacent the bore 54 therein. Preferably, the openings 51 are diamond-shaped and the innermost portions of the openings 51 are positioned very close to the bore 54 so that when the cutter points 50 of the cutting members 45 wear away whereby the openings 51 are exposed, the remaining portion of the cutting members 45 will break into small fragments.

At the time the drill bit apparatus 10 is constructed, the cutting members 45, shafts 52 and bearing sleeves 56 are assembled together as illustrated in FIG. 5 and the bearing sleeves 56 inserted into corresponding openings in the drill members 24 and 26 and drilling fluid conduit 42. In operation, as the cutting face of the drill bit wears away, the rotatable cutting members 45 in contact with the formation being drilled also wear away. As mentioned above, when the cutting points 50 of the cutting members 45 wear away to the point whereby the openings 51 disposed therein are exposed, the cutting members 45 are broken into small fragments. When the cutting members 45 break up, the shaft 52 and bearing sleeve 56 come apart. That is, the segments 62 and parts 64 and 66 making up the segments 62 of the shaft 52 come apart and the segments 70 and parts 72 and 74 making up the bearing sleeve 56 come apart. Thus, the cutting members 45, shaft 52 and bearing sleeve 56 are automatically reduced to small fragments and pieces which are readily carried out of the well bore being drilled by the drilling fluid circulated therethrough.

As stated above, because the improved rotary drill bit of the present invention can be of a length such that it does not wear down completely during the drilling of a well bore, and because the cutting edges on the cutting face of the drill bit are self-renewing and rows of the rotatable cutting members are continuously brought into contact with the formation being drilled as the cutting face of the drill bit wears away, a single drill bit can be utilized in drilling a well bore whereby the necessity of periodically pulling the drill string to replace the drill bit is obviated. Further, the rotatable cutting members including the shafts and bearing sleeves associated therewith automatically break and come apart into small pieces and fragments whereby the pieces and fragments are continuously removed from the well bore by the circulating drilling fluid.

While presently preferred embodiments of the present invention have been described herein for purposes of this disclosure, numerous changes in the arrangement and construction of parts can be made by those skilled in the art, which changes are embodied in the spirit of this invention as defined by the appended claims.

What is claimed is:

1. An improved rotary drill bit comprising:

an elongated generally cylindrical outer drill member having an upper end and a lower end forming an annular cutting face;

an elongated generally cylindrical inner drill member disposed within said outer drill member having a length corresponding to said outer drill member, an upper end and a lower end forming an annular cutting face;

a plurality of vertically spaced rows of rotatable cutting members positioned around and between said inner and outer drill members and journaled thereto whereby as the lowermost row of said rotatable cutting members and said lower ends of said drill members wear away, the next adjacent row of cutting members is exposed;

a drilling fluid conduit disposed within said inner drill member for conducting drilling fluid from the upper ends of said inner and outer drill members to the lower ends thereof; and means for connecting said outer drill member, inner drill member and drilling fluid conduit to a string of drill pipe and for conducting drilling fluid to said drilling fluid conduit attached to the upper ends of said outer drill member, inner drill member and drilling fluid conduit.

2. The drill bit of claim 1 which is further characterized to include at least one continuous longitudinally extending cutter plate disposed within and attached to the inside surfaces of said drilling fluid conduit.

3. The drill bit of claim 2 wherein each of said rotatable cutting members is star-shaped and is journaled to said inner drill member by a removable shaft extending from one side thereof.

4. The drill bit of claim 3 wherein said rotatable cutting members each include a plurality of spaced apart openings positioned parallel to and adjacent said shaft whereby when the points of said members wear away said openings are exposed and said members break into fragments.

5. The drill bit of claim 4 wherein each of said removable shafts are formed of a plurality of small interlocking pieces whereby when said cutting members wear away and are fragmented, said pieces making up said shafts come apart.

6. The drill bit of claim 2 which is further characterized to include a second plurality of vertically spaced rows of rotatable cutting members positioned around and between said inner drill member and said drilling fluid conduit and journaled thereto.

7. The drill bit of claim 6 wherein each of said plurality of rotatable cutting members is star-shaped and is journaled to said drilling fluid conduit by a removable shaft extending from one side thereof.

8. The drill bit of claim 7 wherein said rotatable cutting members each include a plurality of spaced apart openings positioned parallel to and adjacent said shaft whereby when the points of said members wear away said openings are exposed and said members break into fragments.

9. The drill bit of claim 8 wherein each of said removable shafts are formed of a plurality of small interlocking pieces whereby when said cutting members wear away and are fragmented, said pieces making up said shafts come apart.

10. An improved rotary drill bit comprising:

an elongated generally cylindrical outer drill member having an upper end and a lower end forming an annular cutting face and having a plurality of vertically spaced rows of diamond-shaped openings disposed in the sides thereof, the diamond-shaped openings in adjacent rows being offset from each other and overlapping at their upper and lower ends whereby as said lower end of said outer drill member wears away, cutting edges are continuously formed therein by said diamond-shaped openings;

a plurality of elongated generally cylindrical inner drill members concentrically disposed one within the other and within said outer drill member, each of said inner drill members having upper ends and lower ends forming annular cutting faces and having a plurality of vertically spaced rows of diamond-shaped openings disposed in the sides thereof, the diamond-shaped openings in adjacent rows being offset from each other and overlapping at their upper and lower ends whereby as the lower ends of said inner drill members wear away, cutting edges are continuously formed thereon by said diamond-shaped openings therein;

a drilling fluid conduit concentrically disposed within the innermost of said inner drill members for conducting drilling fluid from the upper ends of said inner and outer drill members to the lower ends thereof;

a plurality of vertically spaced rows of rotatable cutting members positioned around and between said drill members and between said innermost drill member and said drilling fluid conduit and journaled to said inner drill members and to said drilling fluid conduit whereby as the lowermost rows of said rotatable cutting members and said lower ends of said drilling members and said drilling fluid conduit wear away, the next adjacent rows of cutting members are exposed; and means for connecting said outer drill member, inner drill members and drilling fluid conduit to a string of drill pipe and for conducting drilling fluid to said drilling fluid conduit attached to the upper ends of said inner and outer drill members and said drilling fluid conduit.

11. The drill bit of claim 10 which is further characterized to include at least one continuous longitudinally extending cutter plate disposed within said drilling fluid conduit.

12. The drill bit of claim 11 wherein said outer drill member includes a plurality of spaced continuous vertical recesses formed in the outside surface thereof.

13. The drill bit of claim 11 wherein each of said rotatable cutting members is star-shaped and is journaled to said inner drill members and said drilling fluid conduit by a removable shaft extending from one side thereof.

14. The drill bit of claim 13 wherein said rotatable cutting members each include a plurality of spaced apart openings positioned parallel to and adjacent said shaft whereby when the points of said cutting members wear away, said openings are exposed and said members break into fragments.

15. The drill bit of claim 14 wherein each of said removable shafts are formed of a plurality of small interlocking pieces whereby when said cutting members wear away and are fragmented, said pieces making up said shafts come apart.

16. The drill bit of claim 15 wherein the journal connection of each of said rotatable cutting members to said inner drill members and drilling fluid conduit includes a bearing sleeve formed of a plurality of interlocking pieces whereby when said cutting members wear away and are fragmented, said pieces making up said bearings come apart.

* * * * *